United States Patent [19]

Casper

[11] Patent Number: 5,059,052

[45] Date of Patent: Oct. 22, 1991

[54] PORTFOLIO SYSTEM

[75] Inventor: Chester W. Casper, Greenwood, Ind.

[73] Assignee: T.H.E. Business Products Corporation, Greenwood, Ind.

[21] Appl. No.: 408,565

[22] Filed: Sep. 18, 1989

[51] Int. Cl.[5] ..... B42F 13/00

[52] U.S. Cl. ..... 402/80 R; 281/31

[58] Field of Search ..... 281/31; 402/80 R

[56] References Cited

U.S. PATENT DOCUMENTS

| | | | |
|---|---|---|---|
| 4,552,479 | 11/1985 | Nickow et al. | 281/31 X |
| 4,566,721 | 1/1986 | Friedman et al. | 281/31 |
| 4,575,126 | 3/1986 | Grubbs | 281/31 |
| 4,605,245 | 8/1986 | Weaver | 281/31 X |
| 4,629,349 | 12/1986 | Pitts | 281/31 X |
| 4,890,728 | 1/1990 | Grimsley | 281/31 X |

OTHER PUBLICATIONS

"Handbook for your 5-IN-1 Pocket Day-Timer Planner Diary System", Day Timers, Inc., Allentown, Pa., 1989.

Complete Office Supply, 1989, Office Supplies Catalog, Complete Office Supplies, Inc., Indianapolis, IN.

1989 Office Products Catalog, Circle Office Supplies, Inc., p. 788.

E.B.X. Trading, Inc., All-In-One International Travel Wallet Brochure.

*Primary Examiner*—Paul A. Bell

*Attorney, Agent, or Firm*—Ice Miller Donadio & Ryan

[57] ABSTRACT

A portfolio system is provided for holding materials in an organized manner. The portfolio includes a wallet having a first portion, a second portion, and a hinge portion. The first, second, and hinge portions include an interior and an exterior. The first portion includes a first flap member and a generally transparent second flap member for defining respective first and second interior pockets. The second portion includes a third flap member and generally transparent fourth and fifth flap members. The third, fourth, and fifth flap members define respective third, fourth, and fifth pockets. The second portion also includes a generally transparent exteriorally disposed flap member for defining an exterior pocket.

15 Claims, 7 Drawing Sheets

PORTFOLIO SYSTEM

BACKGROUND OF THE INVENTION

The present invention relates to a portfolio system and, more importantly, to a business organizer-type portfolio designed to hold a variety of information for a business person.

One of the most difficult on-going tasks faced by a business person is information management. Among the information a business person must manage and organize is information relating to appointments, expenses, addresses and telephone numbers, business cards, and general information relating to clients and customers.

A wide variety of devices exist that help the business person organize and manage this material. For example, THE COMPLETE OFFICE SUPPLY 1989 OFFICE SUPPLIES CATALOG, distributed by Complete Office Supply, Inc., of Indianapolis, Ind., discloses a wide variety of currently available information management devices. At pages 247 through 259, THE COMPLETE OFFICE SUPPLY CATALOG shows a variety of rotary files, v-files, and card files useful for recording names and addresses. Among the files shown are various models of ROLODEX brand files. At pages 260 through 276, the catalog discloses a variety of desk-top list finders, address/telephone books, personal reference books, reference organizers, scrapbooks and albums.

In this regard, particular attention is directed to the DAY RUNNER reference organizer shown at page 272 of THE COMPLETE OFFICE SUPPLY CATALOG, and at page 788 of the 1989 OFFICE PRODUCTS CATALOG distributed CIRCLE OFFICE SUPPLIES, INC., of Indianapolis, Ind. The DAY RUNNER organizer comprises a three-ring binder and inserts, placeable in the binder that can hold a variety of business materials in an organized manner.

Other information management tools shown in THE COMPLETE OFFICE SUPPLY CATALOG include the calendars, reminder books, and diaries, shown on pages 285–326 and the catalog cases, attache cases, portfolios, briefcases, ring binders, pad holders, and business cases shown at pages 910–932.

Although all of the various devices discussed above perform their intended function to one extent or another, room for improvement exists.

One of the difficulties faced by a business person is to have an information management system that is sufficiently complete and large enough to be able to hold all the information necessary, while still not being so large that the system is unwieldy. The problem of unwieldiness may not be that acute with those who are "office bound" and thus have enough room to store all the various pads, diaries, books, and card files necessary. However, persons such as salesmen who spend the majority of their time out of the office have a greater need for an easily portable, non-cumbersome portfolio system.

One difficulty with many known prior art devices is that those devices large enough to hold the materials that a business person wants to keep with him are often too large to fit easily within a breast pocket or purse. Although a salesman may have a desire to have all the information he needs to conduct his business at his finger tips, it is rather inconvenient to carry around a large number of books, such as calendar books, address books, and note books from place to place. It would be especially desirable to have a single organizer for organizing all of a business person's currently needed information that was sufficiently small in size to enable the business person to carry it with him in a jacket pocket or small purse. As will also be appreciated, a note book or organizer that cannot fit into a pocket or purse stands a greater chance of being lost or misplaced by the business person than one which is small enough to keep with him in his breast pocket or her purse.

Conversely, those known devices that are small enough to fit within a breast pocket or purse are usually not large enough to serve as a repository for all of the information and materials needed by the business person on a current basis. As will be appreciated, this inability to hold all desired information adversely affects the functionality and desirability of these known pocket-sized portfolio systems.

It is therefore one object of the present invention to provide a portfolio device that is capable of containing the business person's needed materials, but which is small enough to be easily carried by the business person.

SUMMARY OF THE INVENTION

In accordance with the present invention, a pocket portfolio is provided for holding materials in an organized manner. The portfolio comprises a wallet means including a first portion, a second portion, and a hinge portion. The first, second, and hinge portions include an exterior and an interior. The first portion includes a first flap member and a generally transparent second flap member for defining respective first and second interior pockets. The second portion includes a third flap member and generally transparent fourth and fifth flap members. The third, fourth, and fifth flap members define respective third, fourth, and fifth pockets. The second portion also includes a generally transparent exteriorally disposed flap member for defining an exterior pocket.

In the preferred embodiment, the first pocket is sized for receiving an address book, the second pocket is sized for receiving an information card means, and the third pocket is sized for receiving currency. The fourth and fifth pockets are sized for receiving one of a business card, credit card, and an electronic calculator. The exterior pocket is sized for receiving an airline ticket.

Also, the preferred embodiment can include first, second, and third tri-folded information cards sized for being received in the second pocket. The first, second, and third information cards are of varying heights so that when placed in the second pocket, a portion of each of the first, second, and third information cards is visible. Further, the first and third information cards can each include two series of perforations for defining first, second, and third information card segments of each of the first, and third information cards. The first and third segments of the first information card include a series of apertures, and the first, second, and third segments of the third information card include a series of apertures. These apertures permit the aperture containing information card segments to be received by an information storage means, separate from the wallet means.

One feature of the present invention is that the elements of the multi-element portfolio system include a wallet, information cards, and an information storage means such as a binder. The advantage obtained with the applicant's multi-element system is that a wallet is provided that is large enough to hold those materials and information that a business person wishes to keep with him at all times. These materials include such items as airline tickets, currency, business cards, credit cards, and a calculator. The information includes such things as appointment calendars, expense records, client call reports, "to do lists", and idea files, that a business person needs for the "current time" interval (such as that day or week) during which he will be away from the information storage portion of the portfolio system. A binder system is furnished which comprises the information storage element of the multi-element portfolio system.

The business person can store the information not needed in the current time interval, such as old expense reports, old client call records, and old appointment calendars, in the binders. These binders can then be stored in the user's house, car, or office, so as to obviate the user's need to carry these binders with him. By storing these binders in such a place as the user's house, car, or office, there is less likelihood that the business person will lose, misplace, or have stolen, the binders and the information contained therein.

The third component of the multi-element system is the information cards. The information cards are designed to be received in both the wallet and the binder, to facilitate the transfer of the cards between the wallet (when being used), and the binder (when being stored).

Another feature of the present invention is that it includes a seven compartment wallet. The seven compartment wallet has the advantage of being large enough to hold substantially all of the business materials and information required by the business person in the current time interval, but small enough to fit comfortably within the user's breast pocket or purse. The seven pockets are sized and arranged to hold such materials as currency, address books, receipts, checkbooks, information storage cards, business cards, credit cards, and a calculator. Another advantage of the seven pocket wallet design is that it enables the wallet to serve both as a conventional wallet, and also as a business organizer.

Additional features and advantages of the present invention will become apparent to those skilled in the art upon consideration of the following detailed description of a preferred embodiment exemplifying the best mode of carrying out the invention as perceived presently.

DETAILED DESCRIPTION OF THE PREFERRED EMBODIMENT

Figure 5:
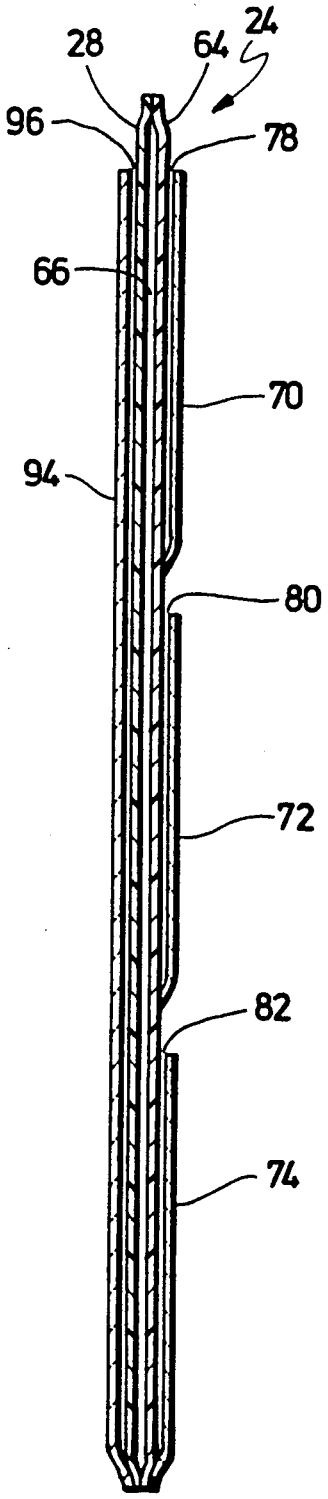
FIG. 5 is a sectional view taken along lines 5—5 of FIG. 2.
Figure 6A:
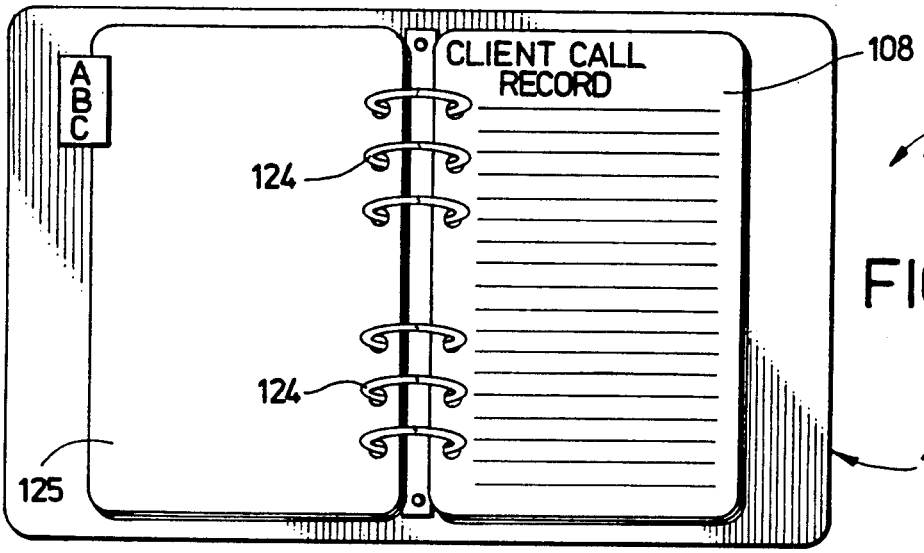
FIG. 6A is an interior view of the information storage means of the present invention.
Figure 6B:
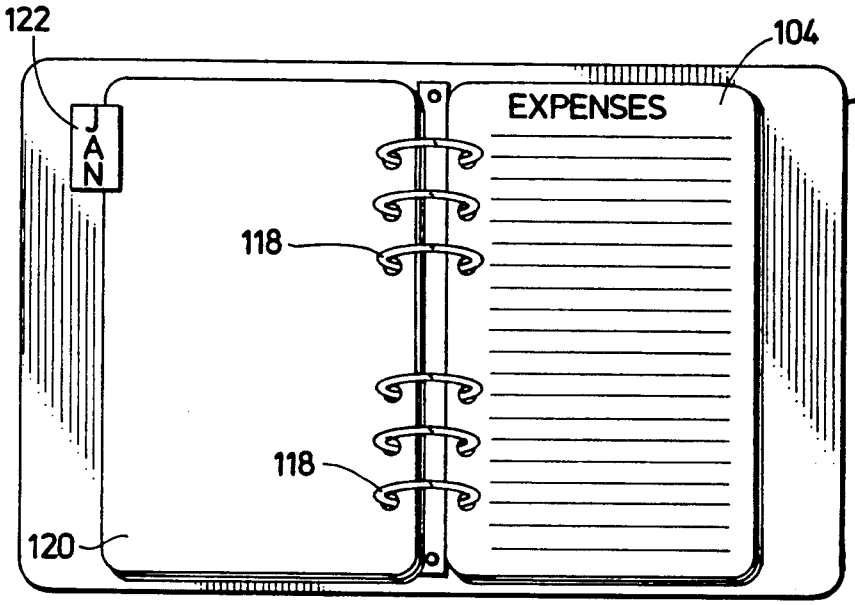
FIG. 6B is an interior view of the information storage means of the present invention.
Figure 6C:
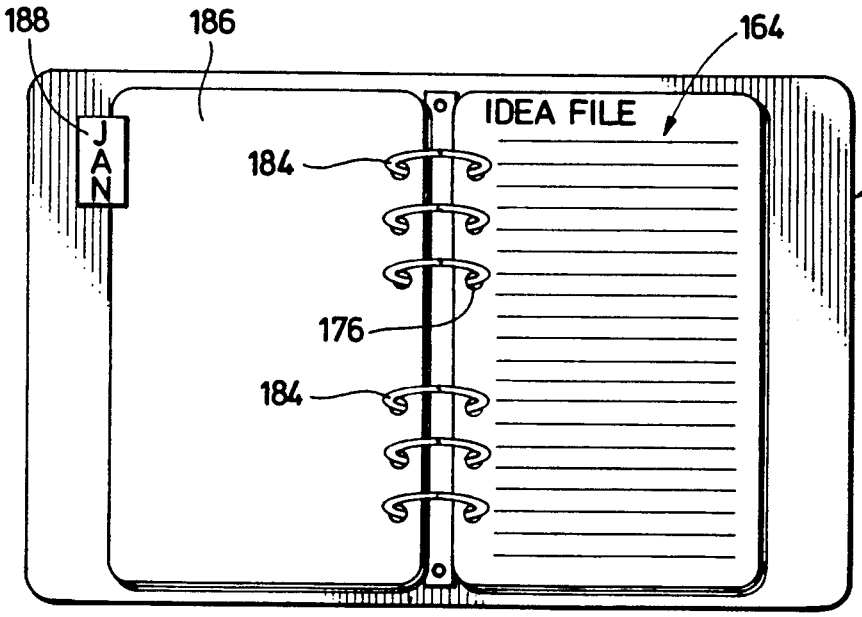
FIG. 6C is an interior view of the information storage means of the present invention.

The multi-element portfolio system of the present invention is shown in the drawings as including a wallet means 12 (FIGS. 1–5), a plurality information cards 14 (FIG. 2 and FIGS. 7A–9B) that are receivable in the wallet means 12, and an information storage means 16 (FIGS. 6A–6C).

Figure 3:
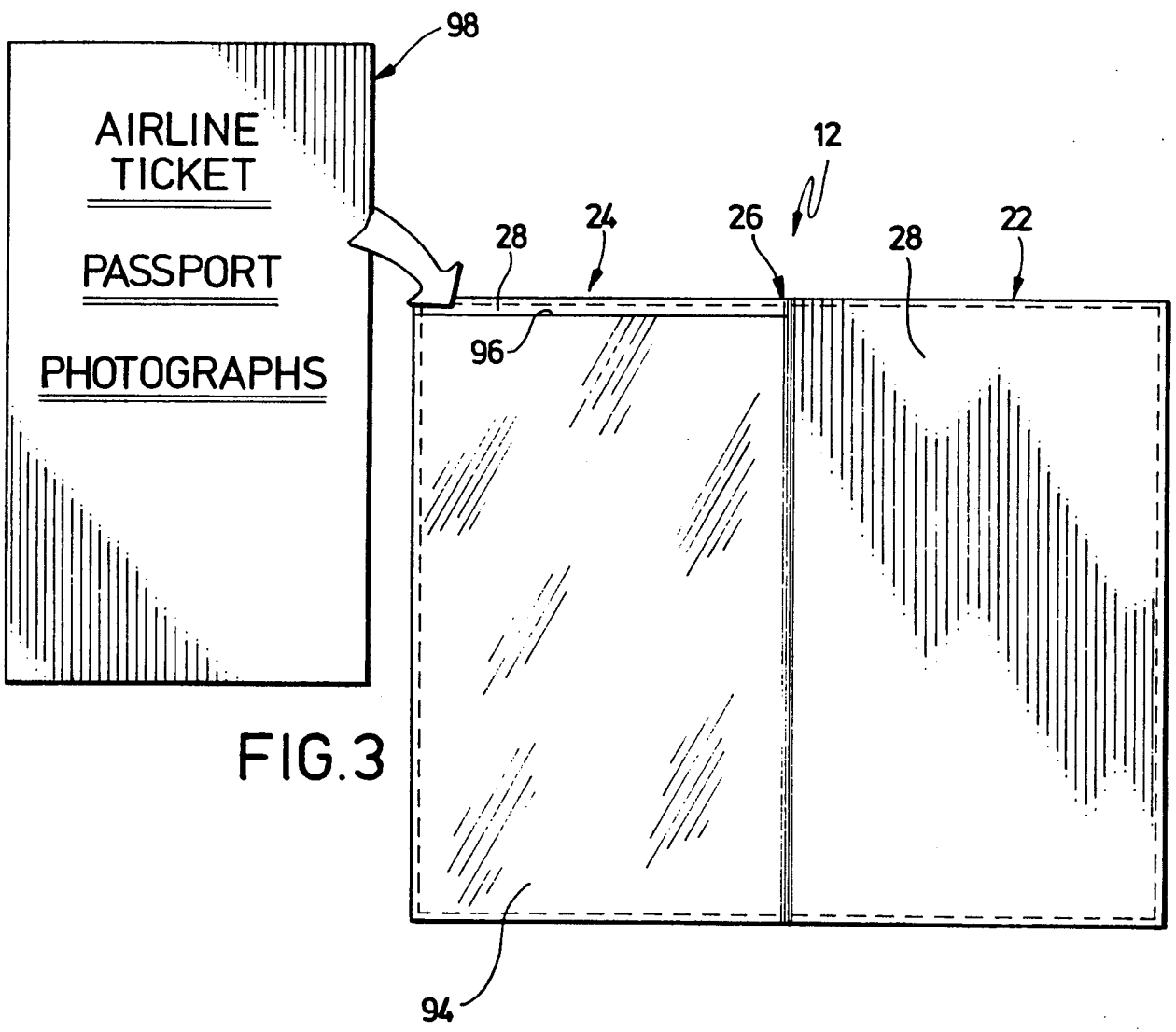
FIG. 3 is an exterior view of the wallet of the present invention in the unfolded position.

As best shown in FIGS. 1–5, the wallet 12 includes a first portion 22, a second portion 24, and a hinge portion 26 that hingedly couples the first and second portions, 22, 24, to permit the wallet 12 to move between a folded position (FIG. 1) wherein the wallet 12 can be conveniently placed in the user's breast pocket or purse, and an open position (FIGS. 2 and 3) that permits the user to gain access to the interior (FIG. 2) of the wallet 12. The wallet 12 includes an interior (FIG. 2) and an exterior (FIG. 3).

Figure 1:
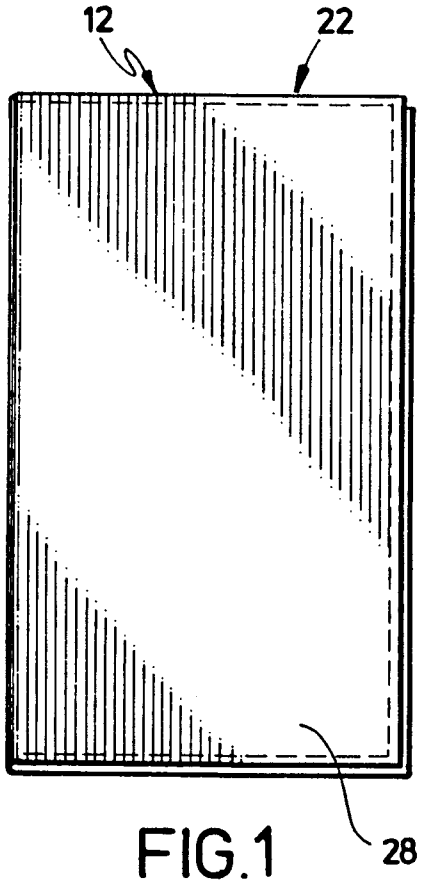
FIG. 1 is a front view of the wallet element of the current invention in a folded position.

The wallet 12 includes a jacket 28 that comprises the primary structural member of the wallet 14, and to which the various flap members are attached. Preferably, the jacket member 28 is made from material such as vinyl, leather, or eelskin to present a pleasing appearance. Jacket 28 is preferably approximately 8.875 inches (22.54 cm) in width, and 7.375 inches (18.73 cm) in height, to give the wallet a size of approximately 8.875 by 7.375 inches (22.54 cm by 18.73 cm) when opened and approximately 7.375 inches (18.73 cm) high, and approximately 4.375 inches (11.11 cm) wide when the wallet 12 is folded, as shown in FIG. 1. A wallet 12, sized according to the dimensions given above, has been found by the applicants to fit conveniently within the breast pocket of most suit coats, and can also fit conveniently within many purses. The wallet 12 includes a first flap member 34, which is also preferably made of vinyl, leather, or eelskin. First flap 34 is attached by stitching 35 along the side edge 36, top edge 38, and the bottom edge 40 of the first flap 34 to the jacket 28. The three sided connection between the first flap 34 and the jacket 28 defines a side-opening first pocket 42. Side pocket 42 is approximately 7 inches (17.78 cm) in height by 3.875 inches (9.84 cm) in width, and is sized to receive an address book, or a check book. As will be appreciated, a standard sized check book is approximately 6.25 inches (15.88 cm) in height and 3.25 inches (8.26 cm) in width, and will, therefore, fit conveniently in the first pocket 42.

A generally transparent second flap member 48 is coupled to the first flap member along the side and bottom edges of the second flap member 48 to define a top and side opening second pocket 50. The second pocket 50 is sized to receive documents having a width of less than about 3.875 inches (9.84 cm). Theoretically, no restrictions exist on the height of any document received by the second pocket 50, so long as the user has no objection to the documents in the second pocket 50 extending upwardly past the top edge of the wallet 12. The second pocket 50 is sized to receive a first or daily planner information card 54, a second or calendar information card 56, and a third or idea file information card 58. More details relating to the information cards, 54, 56, and 58, will be presented below.

The second portion 24 of the wallet 12 includes a third flap member 64 that is preferably comprised of either leather, vinyl, or eelskin. The third flap member 65 is generally similar in size to the first flap member 34, and is attached along its top, bottom, and side edges by stitching 35 to jacket 28 to define a side opening third pocket 66. The third pocket 66 is dimensionally similar to first pocket 42, and is sized to receive receipts, such as credit card receipts and cash receipts, or currency at 68.

Generally transparent fourth, fifth, and sixth flap members 70, 72, 74, are attached to the surface of the third flap member, so that the fourth, fifth, and sixth flap members 70, 72, 74, are disposed interiorly (relative to the wallet 12) of the third flap member 64. The fourth, fifth, and sixth flap members 70, 72, 74, are disposed in an adjacent, top to bottom relationship, and are each attached to the third flap member 64 along three side edges of the fourth, fifth, and sixth flap members 70, 72, 74 to define, respectively, a fourth pocket 78, a fifth pocket 80, and a sixth pocket 82. The fourth pocket 78 has a size of approximately 3.875 inches (9.84 cm) in width, and 2.25 inches (5.72 cm) in height. These dimensions enable the fourth pocket 78 to receive cards, such as business card 86. The fifth pocket 80 is approximately 3.875 inches (9.84 cm) in width, and approximately 2.25 inches (5.72 cm) in height, to receive credit cards, such as VISA, MASTERCARD, and AMERICAN EXPRESS type credit cards.

The sixth pocket 82 is approximately 3.875 inches (9.84 cm) in width, and approximately 2.25 inches (5.72 cm) in height, to receive a small, electronic calculator 90. An example of a calculator that will fit within the sixth pocket is the SHARP MODEL EL-6060 calculator manufactured by the SHARP ELECTRONICS CORPORATION.

Due to the generally flexible nature of the transparent plastic from which the sixth flap member 74 is made, and the configuration of the SHARP calculator 90, the calculator 90 can be operated by applying pressure to the key pad through the sixth flap member 74. This feature eliminates the need to remove the calculator 90 from the sixth pocket 82 when one desires to use it.

Figure 2:
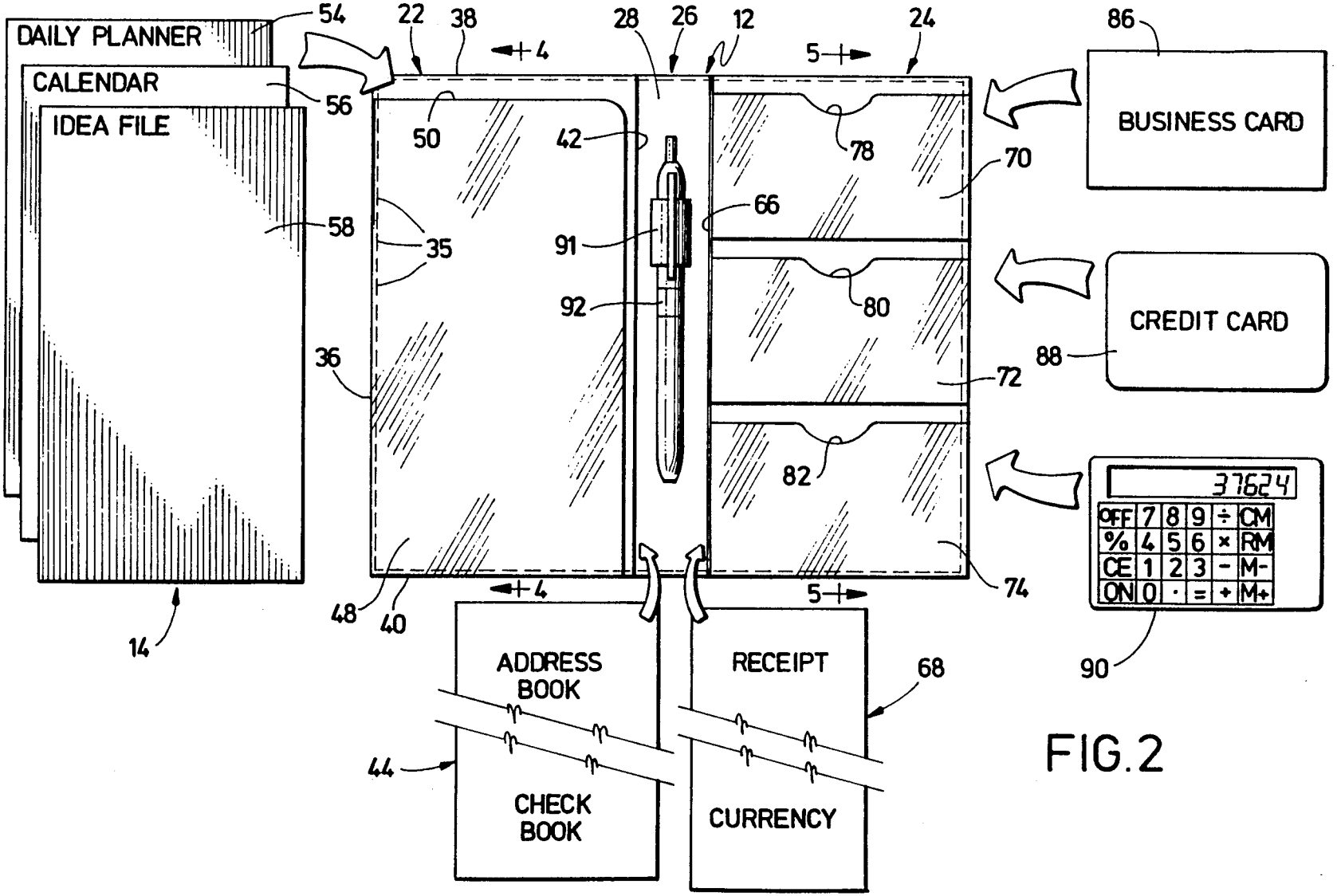
FIG. 2 is an interior view of the wallet in the open position, and the information cards in the folded position.
Figure 4:
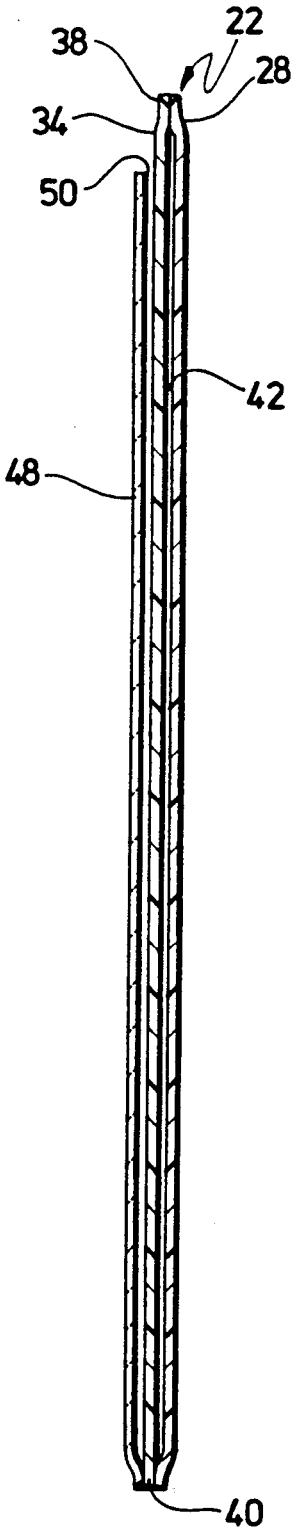
FIG. 4 is a sectional view taken along lines 4—4 of FIG. 2.

The hinge portion 26 is generally flexible to permit the first and second portions 22, 24, to fold about the hinge portion 26 from a folded position (FIG. 1) to an open position (FIGS. 2 and 3). As best shown in FIG. 2, a sleeve 91 is disposed in the interior of the hinged portion 26 for receiving a writing instrument such as pen 92.

As best shown in FIGS. 3 and 5, a seventh flap member 94 is disposed on the exterior of the second portion 24. The seventh flap member 94 is coupled along three side edges to the jacket 28 to define a seventh pocket 96. The seventh pocket 96 has interior dimensions of approximately 4.25 inches (10.80 cm) in width and approximately 7 inches (17.78 cm) in height. The seventh pocket 96 is sized to receive an article such as an airline ticket, passport, or photograph. As will be appreciated, this exterior placement of a seventh pocket 96 is especially advantageous for articles such as airline ticket, or passports, that often must be retrieved during a time when the user has his hands full of other articles such as carry-on luggage.

Referring now to FIG. 2, it will be noticed that the first, 54, second, 56, and third, 58, information cards are designed to be tri-fold cards, and are staggered in height. The information cards, 54, 56, and 58, are staggered in height so that the first card 54 is preferably one-quarter inch (0.64 cm) taller than the second card 56. Similarly, the second card 56 is approximately one-quarter inch (0.64 cm) taller than third card 58. Through this staggered arrangement, at least a portion of the front of each card will be visible when the three cards 54, 56, and 58, are placed in the second pocket 50 in a front to back relation. The visibility provided by this staggered height makes it easier for the user to find and remove the particular information card 54, 56, or 58, that he desires to remove from the second pocket 50.

Each of the information cards 54, 56, 58, are preferably comprised of a relatively stiff cardstock such as a 36 lb. ledger cardstock. The choice of such a cardstock provides the information cards 54, 56, 58, with sufficient stiffness to facilitate writing thereon when the cards 54, 56, 58, are held in one's hand due to the unavailability of a writing surface such as a table or desk.

Figure 7A:
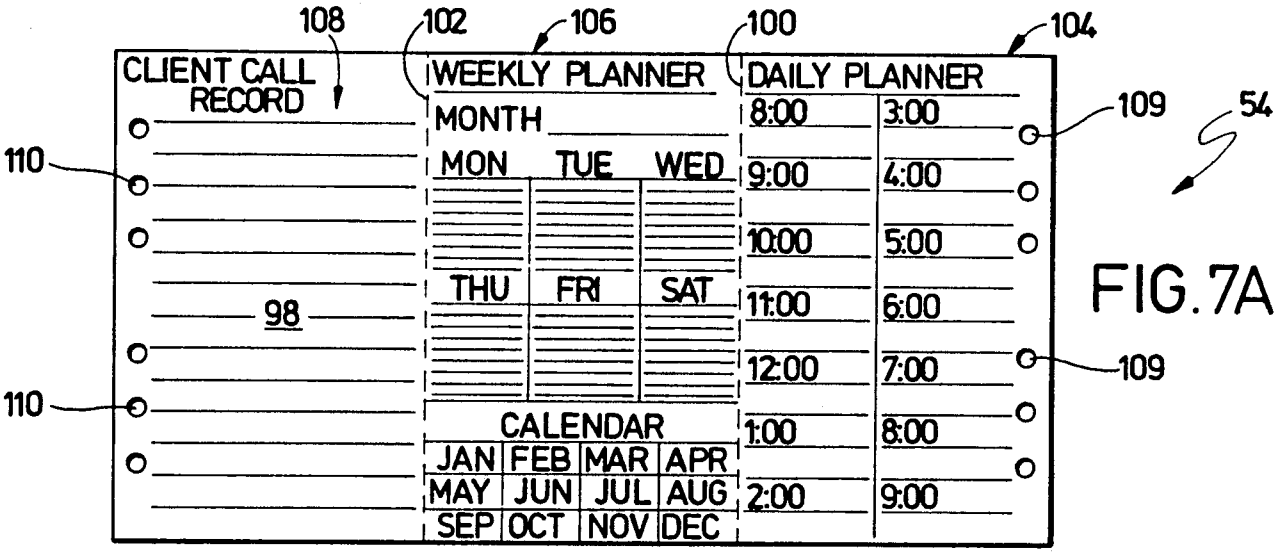
FIG. 7A is a front view of the first information storage card of the present invention.
Figure 7B:
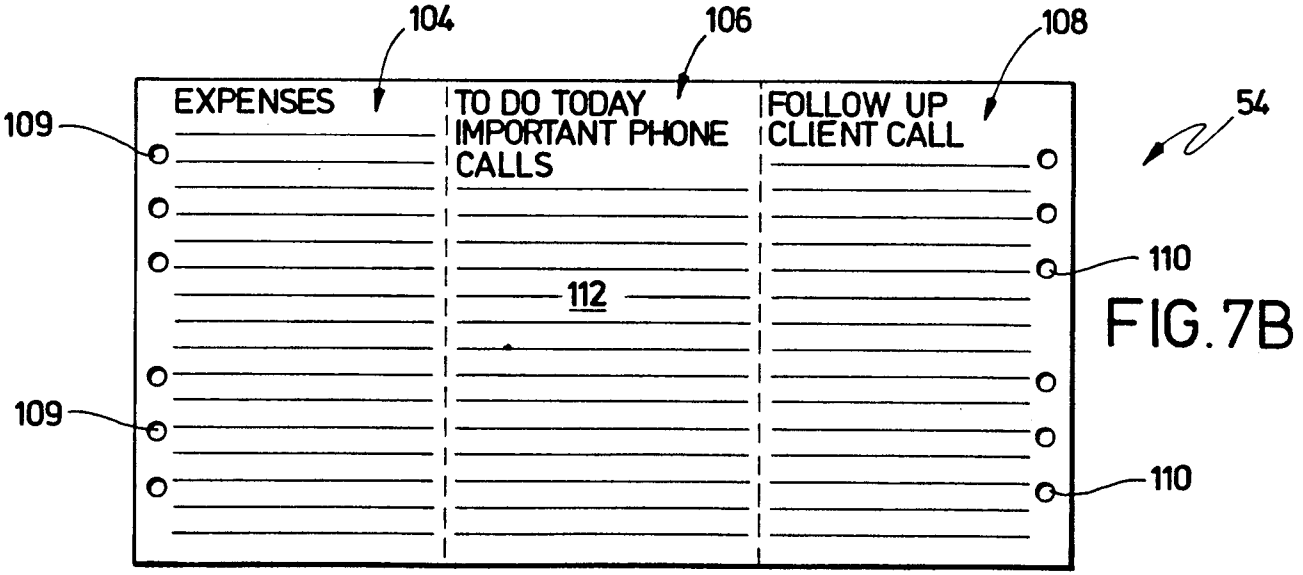
FIG. 7B is a rear-view of the first information storage card of the present invention.

The front side 99 of the first information card 54 is shown in FIG. 7A. The rear face 112 of the first information card 54 is shown in FIG. 7B.

First information card 54 includes a first series of perforations 100, and a second series of perforations 102. The first and second series of perforations, 100, 102, define three separable information card segments, including first information card segment 104, second information card segment 106, and third information card segment 108. The perforations also provide "fold lines" that facilitate movement of the information card 54 between its unfolded position (FIGS. 7A and 7B) and its folded position (FIG. 2).

The first segment 104 of card 54 is configured to be a daily planner wherein the user can make notes regarding appointments and things to do during a particular day. The second segment, 106, is set up as a weekly planner wherein the user can make notes regarding other appointments and things to do during the week. The second segment 106 also includes a one year calendar disposed in the lower portion of the second segment 106. The third segment 108 comprises a client call record section. This third segment 108 predominantly includes blank lines on which the user can write various notes regarding calls on clients.

A first series of apertures 109 extend along the right hand edge of the first segment 104. Similarly, a second set of apertures 110 extend along the left hand section of third segment 108.

The rear face of first information card 54 is shown in FIG. 7B. The rear face 112 of first segment 104 is used as an expense record section. This section contains lines upon which the user can record various expenses, such as meal, lodging, gasoline, repairs, and mileage expenses. The rear face of second segment 106 is provided for enabling the user to list important phone calls and other things on the user's daily "to do" list. The reverse side of the third segment 108 is provided for a user to make notes regarding follow up activities that he must undertake as a result of client calls.

As stated above, the first information card 54 is the largest of the three information cards 54, 56, 58. The preferred dimensions of information card 54 are approximately 12 inches (30.48 cm) in width and 7.125 inches (18.10 cm) in height. When the first, second, and third sections 104, 106, 108, are separated, each of the three sections has a width of approximately 4 inches (10.16 cm).

The perforations 100, 102, enable the information card 54 to be divisible into separate information card segments, 104, 106, 108. When so divided, the first section 104 can be placed in an information storage means, such as first information storage binder 116. Information storage binder 116 includes a plurality of rings 118 that are positioned to receive the apertures 109 of first section 104. Binder 116 also includes an index card 120 having a tab 122. Preferably, the first information binder 116 is organized chronologically, such as by months. First binder 116 comprises an expense binder. Through the inclusion of a year's worth of first sections 104, at the end of the year, binder 116 will include a complete, contemporaneously recorded expense record for the user.

Due to the nature of the subject matter contained on the first segments 104, first binder 116 will comprise a contemporaneously produced expense record suitable for use by the user's accountant to determine expense deductions, or the Internal Revenue Services to verify expenses. Importantly, the user's expense records will be stored in one location, the first binder 116. This single location storage obviates the need for the user to pull relevant expense records from a plurality of sources.

Additionally, a zippered pouch (not shown) can also be provided as a part of first information storage binder 116. Preferably, the pouch has a series of apertures alignable with rings 118, so that the pouch will be held securely within the binder 116. The zippered pouch provides a repository in which the user can store expense receipts such as credit card receipts, cash register receipts, and the like.

When separated, the third information card 108 can be placed in the second information storage binder 123. The second information storage binder 123 also includes a series of rings 124 for receiving the perforations 110 of the third information card segment 108. Information storage binder 123 also includes a tabbed index card 125. Preferably, the tab of index card 125 is organized alphabetically rather than chronologically, to provide the user with an alphabetical listing of information regarding the user's clients.

The second section 106 is preferably discarded when the three sections 104, 106, 108 are separated.

Figure 8A:
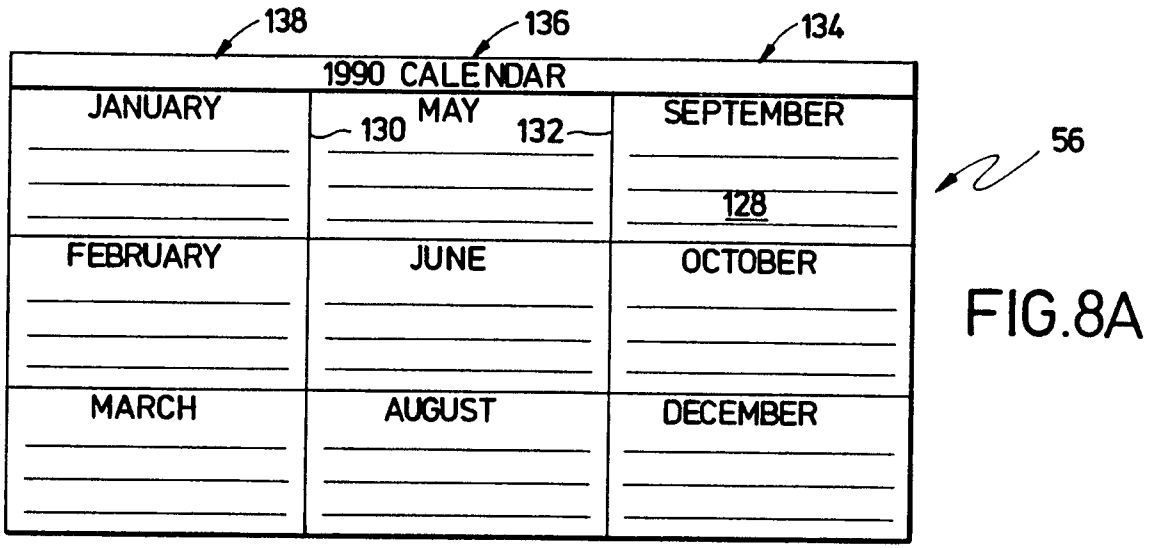
FIG. 8A is a front view of the second information storage card of the present invention.
Figure 8B:
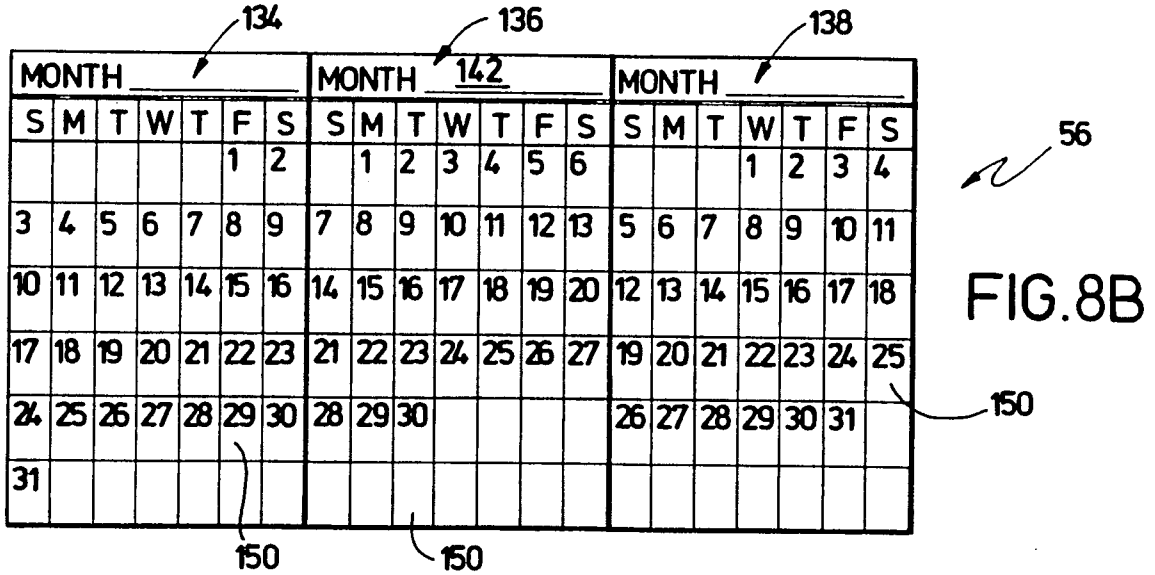
FIG. 8B is a rear-view of the second information storage card of the present invention.

The second information card 56 is best shown in FIG. 8A which shows the front face 128 thereof, and FIG. 8B which shows the rear face 134 thereof. As stated above, the second information card 56 is approximately one-quarter inch (0.64 cm) shorter than first information card 54. Preferably, second information card 56 has a width of about 12 inches (30.48 cm) (the same as information card 54), and a height of approximately 6.875 inches (17.46 cm). The second information card 56 includes a first 128 and second 130 scoring to permit the information card to be moved between its folded position (FIG. 2) and its unfolded position (FIGS. 8A and 8B). As the second information card 56 is preferably discarded after use, there is no need to include a series of perforations.

The scorings 128, 130, define three sections including first information card segment 134, second information card segment 136, and third information card segment 138. Preferably, these three sections, 134, 136, 138 include a pre-printed yearly calendar.

Each of the rear faces of the three sections 134, 136, 138, includes a monthly calendar. Preferably, each of the rear faces of sections 134, 136, 138, comes with a blank grid 150 into which the user can fill in the proper numbers of the days of each of the three months, respectively. Alternately, the days of the months can be preprinted within the grids 150. This three month calendar provides a calendar large enough to enable the user to make notes on each particular day of each particular month, for the user's later reference.

Figure 9A:
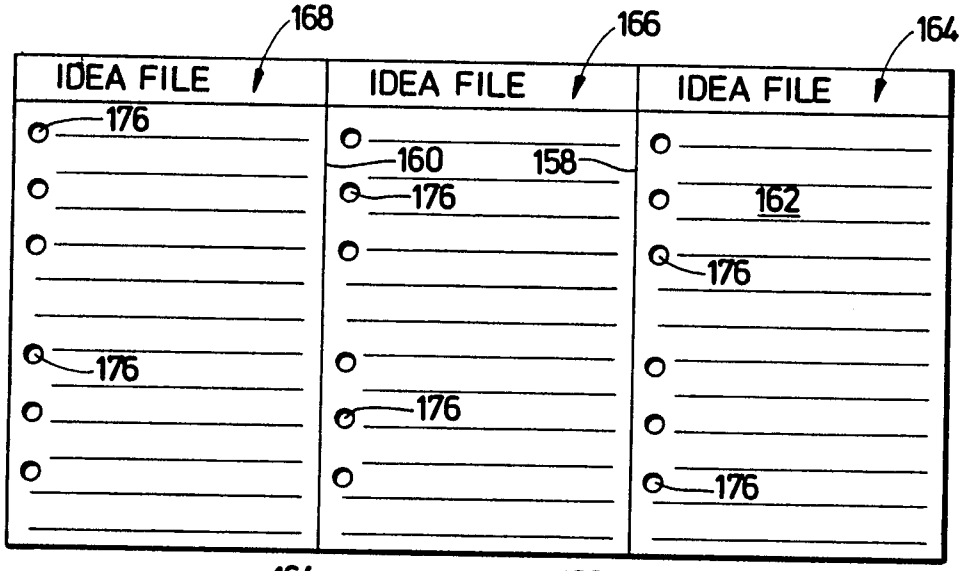
FIG. 9A is a front view of the third information storage card of the present invention.
Figure 9B:
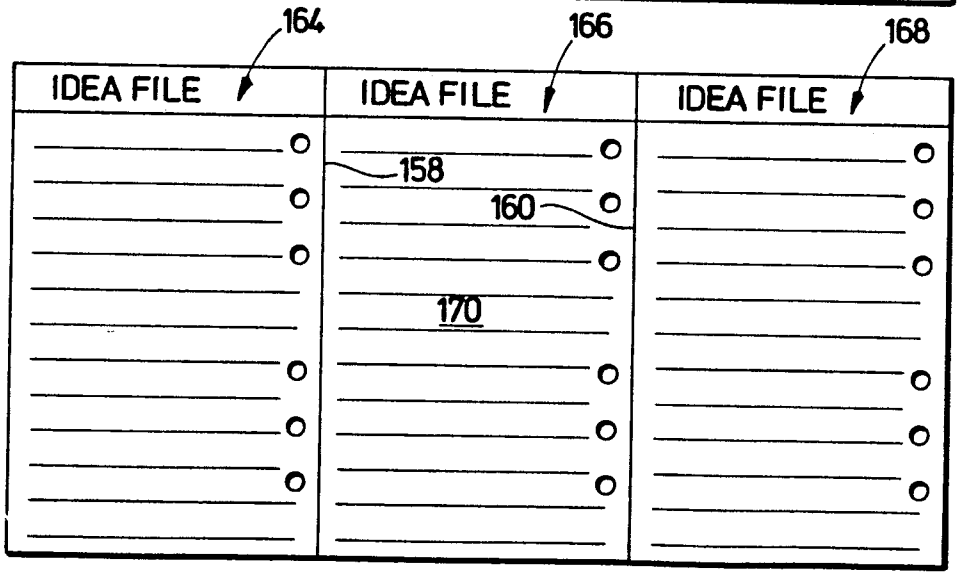
FIG. 9B is a rear-view of the third information storage card of the present invention.

The third information card 58 is shown in FIGS. 9A and 9B. FIG. 9A shows the front face 162 of the third information card 58, and FIG. 9B shows the rear face 170 of the third information card 58. As discussed above, third information card 58 is the shortest of the three information cards 54, 56, 58, and is approximately 6.25 inches (16.83 cm) in height and approximately one-quarter inch (0.64 cm) shorter than second information card 56 and one-half inch (1.28 cm) shorter than first information card 54. The width of third information card 58 is preferably identical to the width of first and second information cards 54, 56.

Third information card 58 includes a first series of perforations 158, and a second series of perforations 160. The first and second series of perforations 158, 160, are generally parallel and extend between the top and bottom of the third information card 58. The first and second series of perforations 158, 160 define three separable information card segments including first information card segment 164, second information card segment 166, and third information card segment 168. Each of the three information card segments, 164, 166, 168, includes a series of apertures 176. Each of the three information card segments 164, 166, 168, comprises an idea file, and predominantly contains a series of blank lines on which the user can write various business and other ideas. This idea file serves as a notebook for the user.

The reverse face 170 of third information card 58 is similar to the front face 162 thereof.

When the first, second, and third information card segments 160, 164, 168, are divided, they can be placed in third information storage binder 182. Third information storage binder 182 includes a series of rings 184 for receiving the apertures 176 in the first, second, and third information card segments 164, 166, 168. An index card 186, having a tab 188 is also provided. Tabs 188 are preferably arranged chronologically, similar to tabs 122 of first binder 116.

Third information storage binder 182 comprises a chronological notebook for the user containing various notes and ideas relating to business and other matters.

Although the invention has been described in detail with reference to the illustrated preferred embodiments, variations and modifications exist within the scope and spirit of the invention as described and as defined in the following claims.

What is claimed is:

1. A pocket portfolio for holding materials in an organized manner, comprising a wallet means including a first portion, a second portion, and a hinge portion, the first, second, and hinge portions including an interior and an exterior, and the hinge portion positioned for hingedly coupling the first and second portions, the wallet means being sized for being received in a suit coat interior pocket, the first portion including a first flap member having three side edges coupled to the wallet to define a side-opening first pocket, a generally transparent second flap member disposed interiorly adjacent to the first flap member, the second flap member having two side edges coupled to the first flap member to define a top and side opening second pocket, the second portion including a third flap member having three side edges coupled to the wallet to define a side opening third pocket, generally transparent fourth, fifth, and sixth flap members disposed interiorly of the third flap member, each of the fourth, fifth, and sixth flap members having three side edges attached to the third flap member to define, respectively, top opening fourth, fifth, and sixth pockets disposed in a top-to-bottom relation, and, a generally transparent seventh flap member disposed on the exterior of the second portion, the seventh flap portion having three side edges attached to the second portion for defining a seventh pocket, a first tri-folded, information card having two series of perforations to define first, second, and third information card segments including a series of apertures for being received by a ringed information card binder separate from the wallet means, wherein the first pocket is sized for receiving the first tri-folded information card.

2. The portfolio of claim 1 wherein the second pocket is sized for receiving an information card means, the third pocket is sized for receiving currency, the fourth pocket is sized for receiving business cards, the fifth pocket is sized for receiving credit cards, the sixth pocket is sized for receiving an electronic calculator, and the seventh pocket is sized for receiving an airline ticket.

3. The portfolio of claim 2 further comprising second, and third information cards, the first, second, and third information cards being of varying height so that when placed in the second pocket, a portion of each of first, second, and third information cards is visible.

4. The portfolio of claim 1, further comprising at least one information card storage means for storing information cards away from the wallet.

5. The portfolio of claim 4 further comprising a third information card including apertures therein, and wherein the card storage means comprises first, second, and third binders, the binders including rings positioned for receiving the apertures of the information cards.

6. The portfolio of claim 5 wherein the first and third segments of the first information card include a series of apertures to permit the first and third information card segments of the first information card to be received by the rings of the respective first and second binders, the third information card having two series of perforations for defining first, second, and third separable information card segments, the first, second, and third information card segments of the third information card including a series of apertures to permit the first, second, and third information card segments to be received by the rings of the third binder.

7. The portfolio of claim 6 wherein the hinged portion includes a sleeve means for receiving a writing instrument.

8. A pocket portfolio for holding materials in an organized manner, the portfolio comprising, a wallet means sized for being received into an interior suit pocket the wallet means including a first portion, a second portion, and a hinge portion, the first, second, and hinge portions including an exterior and an interior, the first portion including a first flap member and a generally transparent second flap member for defining respective first and second interior pockets, the second portion including a third flap member, and generally transparent fourth and fifth flap members, the third, fourth, and fifth flap members defining respective third, fourth, and fifth pockets, the second portion also including a generally transparent exteriorly disposed flap member for defining an exterior pocket and a first, tri-folded information card sized for being received in the second pocket, the first information card having two series of perforations to define first, second and third separable information card segments, the first and third information card segments each including a series of apertures for enabling the first and third segments to be received by a ringed, information card storage binder separate from the wallet means.

9. The portfolio of claim 8 wherein the first pocket is sized for receiving an address book, the third pocket is sized for receiving currency, the fourth pocket is sized for receiving one of a business card, a credit card, and an electronic calculator, the fifth pocket is sized for receiving one of a business card, credit card, and an electronic calculator, and the exterior pocket is sized for receiving an airline ticket.

10. The portfolio of claim 8 wherein the second portion further includes a generally transparent sixth flap member, wherein the fourth, fifth, and sixth flap members are disposed in a generally co-planar top-to-bottom relation.

11. The portfolio of claim 8 further comprising at least one ringed binder for receiving the aperture-containing information card segments.

12. The portfolio of claim 8 further comprising second, and third tri-folded information cards sized for being received in the second pocket, the first, second, and third information cards being of varying height so that when placed in the second pocket, a portion of each of the first, second, and third information cards is visible.

13. The portfolio of claim 8 further comprising, an information storage means separate from the wallet means, and second, and third tri-folded information cards sized for being received in the second pocket, the third information card including two series of perforations for defining first, second, and third information card segments of the third information card, the first, second, and third information card segments of the third information card, the first, second and third information card segments of the third information card including a series of apertures to permit the aperture containing information card segments to be received by the information storage means.

14. The portfolio of claim 13 wherein the information storage means comprises a first, second, and third ringed binders.

15. A portfolio system for holding materials in an organized manner, comprising (1) a wallet means sized for being received in a suit coat breast pocket, the wallet means including a first portion, a second portion, and a hinge portion, the first, second, and hinge portions including an interior and an exterior, the hinge portion being positioned for hingedly coupling the first and second portions, (a) the first portion including (i) a first flap member having three side edges coupled to the interior of the first portion to define a side opening pocket sized to receive at least one of an address book and checkbook, and (ii) a generally transparent second flap member disposed interiorly adjacent to the first flap member, the second flap member having two side edges attached to the first flap member to define a side and top opening second pocket, (b) the second portion including (i) a third flap member having three side edges attached to the interior of the second portion to define a side opening pocket-sized to receive currency, (ii) generally transparent fourth, fifth, and sixth flap members disposed interiorly of the third flap member, each of the fourth, fifth, and sixth flap members having three side edges attached to the third flap member to define, respectively, fourth, fifth, and sixth pockets disposed in a top-to-bottom relation, the fourth, fifth, and sixth pockets being sized to receive a business card, a credit card, and an electronic calculator, respectively, and (iii) a generally transparent seventh flap member having three side edges coupled to the exterior of the second portion to define a top-opening seventh pocket, the seventh pocket being sized to receive an airline ticket, (2) first, second, and third tri-folded information cards sized for being received in the second pocket, the first, second, and third information cards being of varying heights that when placed in the second pocket, a portion of each of the first, second, and third information cards is visible, the first information card including two series of perforations to define separable first, second, and third information card segments each including a series of apertures, the third information card including two series of perforations to define separable first, second, and third information card segments, each of the first, second, and third information card segments including a series of apertures, and (3) an information storage means comprising (a) a first binder having a series of rings for receiving the apertures of the first information card segment of the first information card, (b) a second binder having a series of rings for receiving the apertures of the third information card segment of the first information card, and (c) a third binder having a series of rings for receiving the apertures of the first, second, and third information card segments of the third information card.

* * * * *

UNITED STATES PATENT AND TRADEMARK OFFICE

CERTIFICATE OF CORRECTION

PATENT NO. : 5,059,052

DATED : October 22, 1991

INVENTOR(S) : Chester W. Casper

It is certified that error appears in the above-identified patent and that said Letters Patent is hereby corrected as shown below:

Column 11, Line 24; "a side opening pocket-sized to".... should be "a side opening pocket sized to"

Signed and Sealed this

Ninth Day of March, 1993

*Attest:*

STEPHEN G. KUNIN

*Attesting Officer*

*Acting Commissioner of Patents and Trademarks*